United States Patent [19]

Johnson

[11] Patent Number: 4,494,778

[45] Date of Patent: Jan. 22, 1985

[54] CASING HANGER

[75] Inventor: Clarence W. Johnson, Calgary, Canada

[73] Assignee: Bralorne Resources Limited, Alberta, Canada

[21] Appl. No.: 360,561

[22] Filed: Mar. 22, 1982

[51] Int. Cl.[3] ..... F16L 39/00

[52] U.S. Cl. ..... 285/146; 285/147

[58] Field of Search ..... 285/146, 147, 148, 145, 285/144

[56] References Cited

U.S. PATENT DOCUMENTS

| | | | |
|---|---|---|---|
| 2,610,689 | 9/1952 | Eckel | 285/147 |
| 2,874,437 | 2/1959 | Anderson | 285/146 X |
| 3,068,027 | 12/1962 | Lewis et al. | 285/144 |
| 3,130,987 | 4/1964 | Johnson | 285/146 |
| 3,329,448 | 7/1967 | Allen | 285/147 |

*Primary Examiner*—Thomas F. Callaghan

*Attorney, Agent, or Firm*—John R. Uren

[57] ABSTRACT

A casing hanger for hanging well casing and sealing the well pressure from the atmosphere. The casing hanger comprises a cooperating slip and slip bowl adapted to grip and retain the well casing when they abut a cooperating shoulder on the casing head whereupon the casing hanger will be in its operating position. A seal is adapted to be compressed when the casing hanger is moved downwardly and forms the seal when the casing hanger reaches its operating position. A manually adjustable bolt can increase or decrease the seal pressure without disturbing the well casing.

10 Claims, 3 Drawing Figures

CASING HANGER

INTRODUCTION

This application relates to a casing hanger for use on production well casing used on oil and gas wells.

BACKGROUND OF THE INVENTION

To prevent contamination of shallow freshwater sources, confine shallow gas zones and prevent the cave-in of unconsolidated rock formations, surface casing is inserted into the well when an appropriate depth has been reached. Cement is pumped up between the casing and the rock and drilling continues when the cement has set. A casing head is attached to the top of the surface casing.

When the drill bit reaches total depth and the well is to be placed on production, it must be cased to prevent it from caving in and to facilitate completion, production and maintenance operations. This production casing, after installation, has cement pumped between it and the annular space between the casing and the rock. The cement secures the casing in the hole and isolates the various zones from each other to keep the pressurized fluids in these drilled zones intact.

Because of the large weight of the production casing, a proportion, say 30–50%, must be borne by the casing hanger which is seated within the casing head. The casing hanger also acts as a seal to isolate the well pressure and well fluid or gas from the atmosphere.

Previous casing hangers have suffered from various disadvantages. On some, the wedge action in the casing hanger resulting from the weight of the production casing resulted in a prohibitively large compressive load. This force could cause a compressive failure in the production casing or a "bottleneck" resulting in reduced internal diameter which could hamper the insertion of various components and tools into the well.

A further disadvantage with previous casing hangers was that the seal used was not supported across its entire area. When testing occured to determine seal effectiveness following removal of the blow-out preventer, the seal could deflect in a cantilever type action which resulted in premature seal failure.

Yet a further disadvantage with prior casing hangers is that the seal action is not automatic upon release or lowering of the production casing into the gripping teeth. This made the seal effectiveness uncertain and in some hangers, a manual adjustment was required to obtain seal action after suspending the weight of the production casing from the slips and removing the blow-out preventer.

A further disadvantage in some casing hangers is that the seal is located beneath the gripper teeth which permits the flange seal test pressure to "add" to the slip imposed radial loads, thus increasing the possibility of "bottle necking" the casing.

BRIEF SUMMARY OF THE INVENTION

In accordance with the invention, there is disclosed a casing hanger for use in supporting production well casing within a casing head having an internal surface adjacent the upper end thereof, said casing hanger comprising slip bowl means operable to be seated on a shoulder within said casing head, slip means cooperating with said slip bowl means and having threads thereon adapted to grip said well casing, flexible seal means supported across its bottom area by said slip bowl means, cap wedge plate means, spreader means below said cap wedge plate means having an external surface for cooperating with said casing head internal surface, lower wedge plate means between said flexible seal means and said spreader means and attachment means threadedly engaging said slip bowl means and retaining said slip bowl means, said flexible seal, said lower wedge plate means, said spreader means and said cap wedge plate means, whereby the spreader means external surface contacts the internal surface of the casing head which tends to separate the cap wedge plate from the lower wedge plate to compress the flexible seal means and to create a seal between the casing and the casing head.

BRIEF DESCRIPTION OF THE SEVERAL VIEWS OF THE DRAWINGS

In drawings, which illustrate an embodiment of the invention.

DESCRIPTION OF SPECIFIC EMBODIMENT

Figure 1:
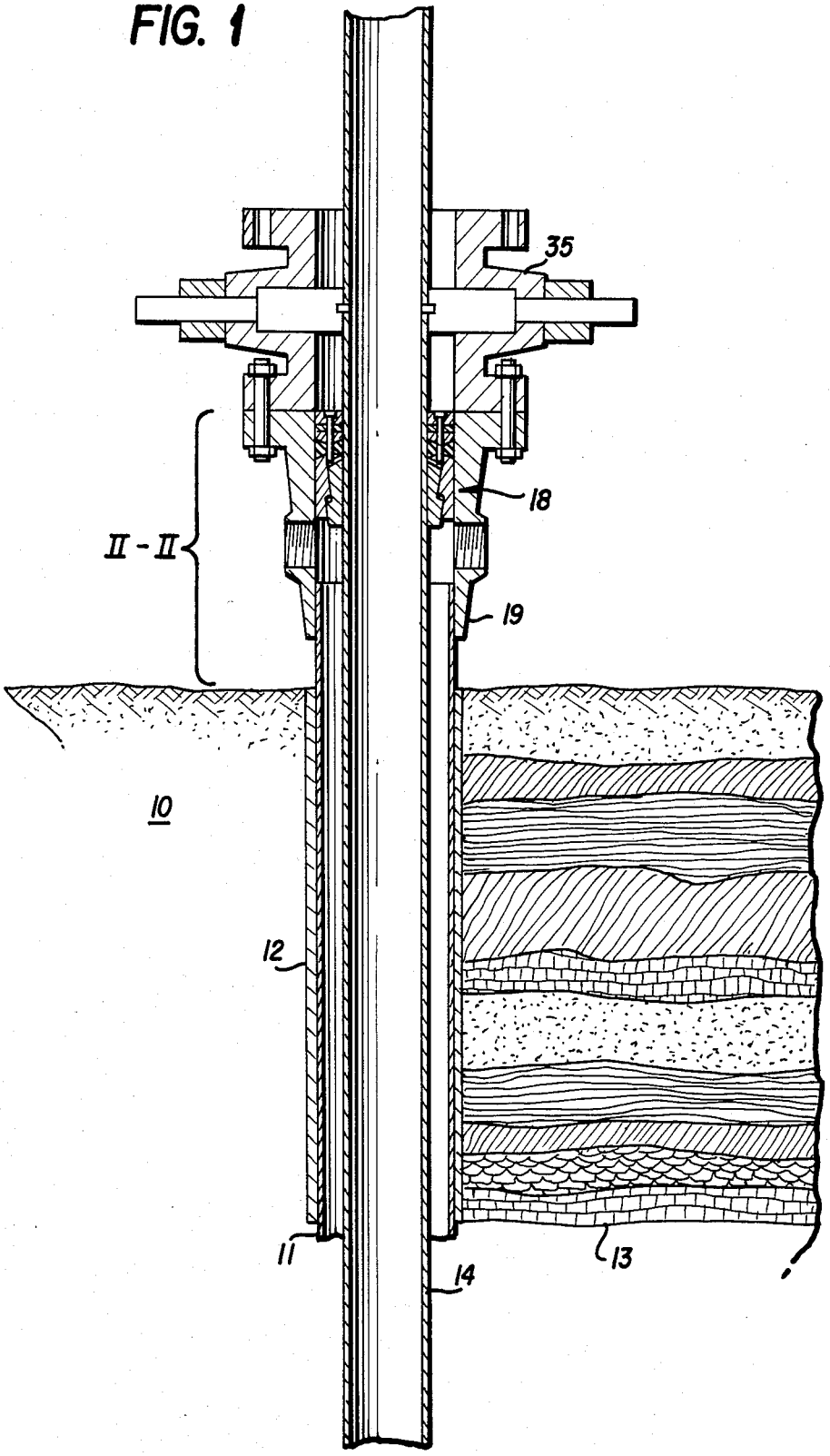
FIG. 1 is a diagrammatic cross-sectional view showing an oil or gas well with a blow out preventer and casing hanger in place on the casing head.

Referring to the drawings, a typical producing petroleum or gas well is shown generally at 10 in FIG. 1. It comprises surface casing 11 cemented by cement 12 in the overburden 13. The production casing 14 is positioned subsequent to drilling and is lowered into place by draw works (not shown) on the drilling rig (not shown). It is undesirable, however, to place the entire weight of the production casing 14 on the bottom of the well since the weight can become great enough to cause a compressive failure in the casing 14 at the bottom portions of the well. Accordingly, a casing hanger shown generally at 18 is utilized which will carry from one-third to one-half of the weight of the production casing 14 and, as well, which will provide a seal which will isolate the well pressure from the atmosphere.

Figure 2:
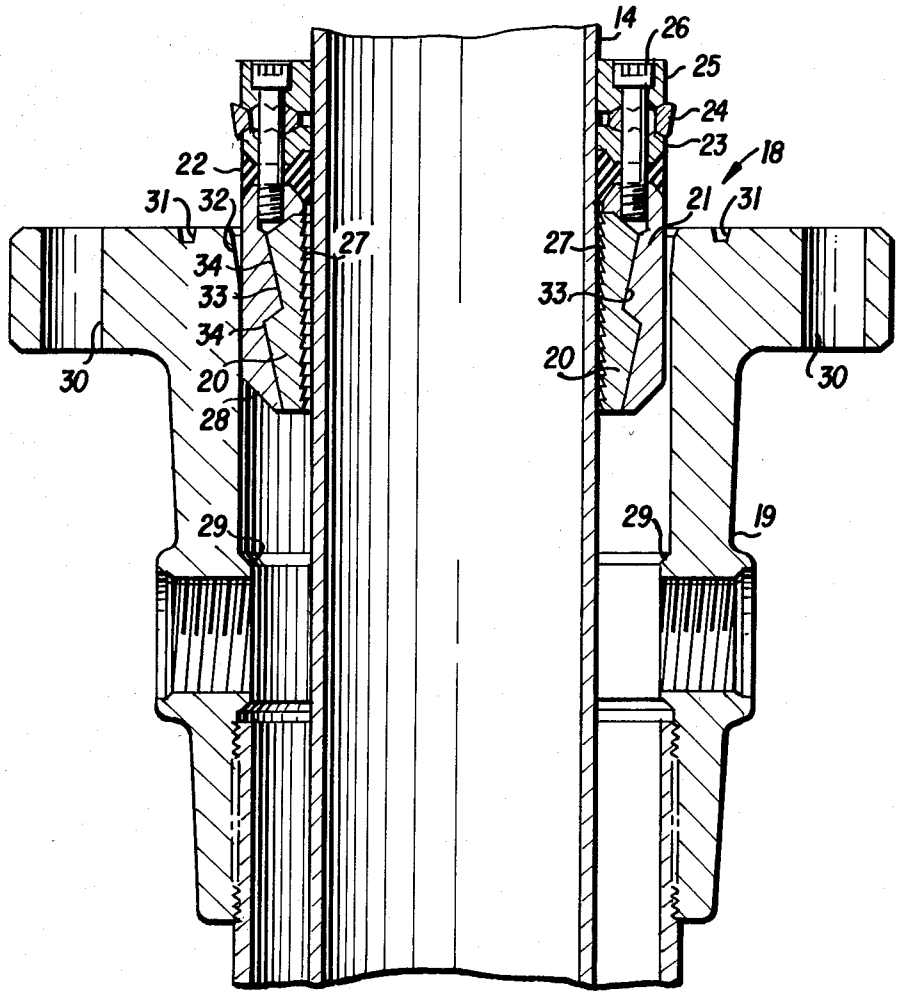
FIG. 2 is an enlarged cross-sectional view of the casing head area noted II—II in FIG. 1 without the blow-out preventer and with the casing hanger in position prior to installation.

Referring now to FIG. 2, the casing hanger 18 is shown being lowered down the suspended production casing 14 into the casing head 19. The casing hanger 18 comprises a cap wedge plate 25, and a lower wedge plate 23, separated by spreaders 24. A flexible seal 22 is positioned between the underside of lower wedge plate 23 and the upper surface of slip bowl 21. Fasteners in the form of bolts 26, retain the cap wedge plate 25, the spreaders 24, the lower wedge plate 23, and the flexible seal 22 to the slip bowl 21. The slip bowl 21 comprises a hollow cylinder having an upper surface that conforms to the shape of the underside of flexible seal 22, stepped conical inner diameters 34 and a shoulder 28 adapted to abut and cooperate with a similar shoulder 29 in casing head 19. Slips 20 are segments of a cylinder having stepped conical external surfaces 33 and an inner diameter machined with a sharp edged thread 27 of a diameter that will grip the outside of production casing 14.

The casing head 19 has bolt holes 30 drilled through a flange on which the blow-out preventer or production apparatus may be mounted. A circular groove 31 is adapted to hold a metal seal ring (not shown) for use on the blow-out preventer and on the production apparatus when installed.

OPERATION

In operation, it will be assumed that the drilling has been completed, the drill string and bit have been removed from the well and the production casing 14 is hanging from the derrick (not shown) of the drill rig with its total weight being borne by the rig or by a combination of the derrick and the rock formation which has been drilled.

Casing hanger 18 is positioned around the periphery of production casing 14 and is axially lowered thereon through the blow-out preventer (not shown) until spreaders 24 contact casing head 19. Casing hanger 18 is moved further downwardly and spreaders 24 move inwardly by the taper 32 in casing head 19 which tends to separate cap wedge plate 25 from lower wedge plate 23. Bolt 26 maintains a constant distance between the cap wedge plate 25 and the slip bowl 21 and, therefore, flexible seal 22 expands radially to create a seal between the production casing 14 and the casing head 19.

Figure 3:
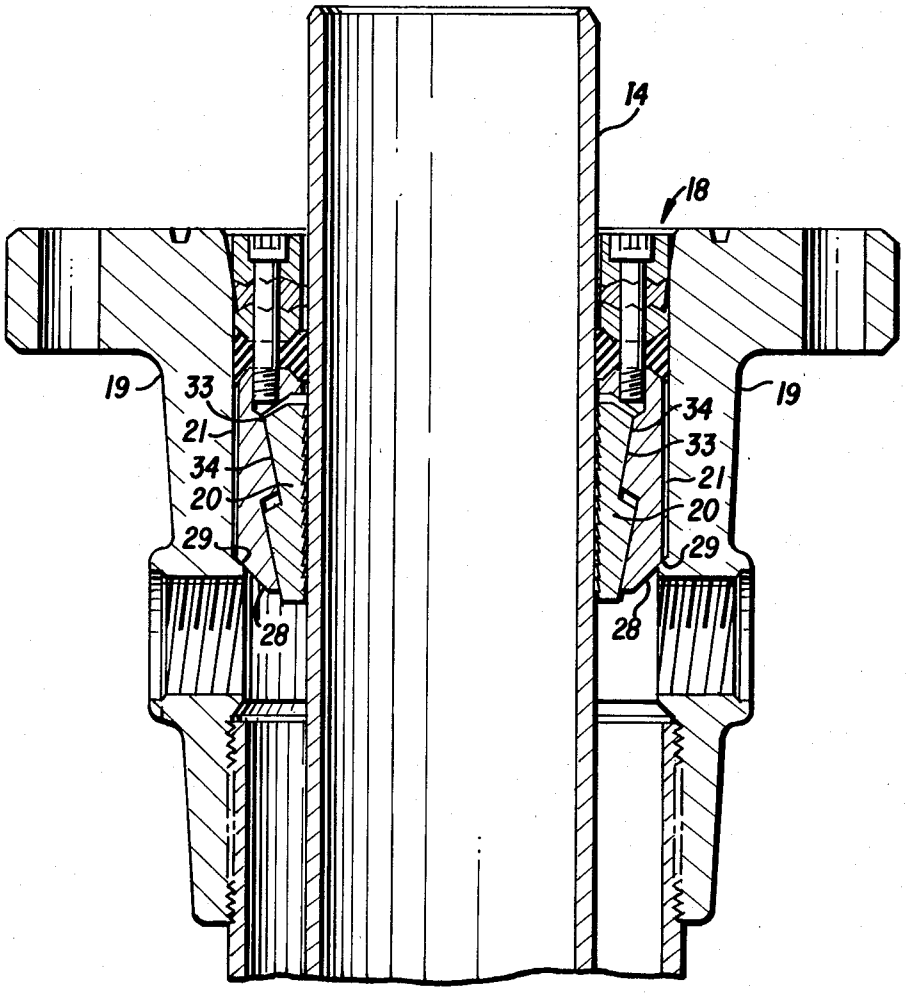
FIG. 3 is a view similar to that of FIG. 2 with the casing hanger shown in operable position.

Production casing 14 is lowered from the derrick while the casing hanger 18 moves downwardly within casing head 19 until it is in the position shown in FIG. 3 with the shoulder 28 of the slip bowl 21 contacting shoulder 29 of casing head 19.

In FIG. 3, the slips 20 are shown gripping and supporting a portion of the weight of production casing 14 as a result of the wedging action between the conical inner diameters 34 of slip bowl 21 and the external conical surfaces 33 of slips 20.

After the casing hanger 18 has reached the position shown in FIG. 3, pressure is applied between the closed blow-out preventer 35 (FIG. 1) and the top of the casing hanger 18 to determine seal effectiveness. Assuming the seal is effective, the blow-out preventer is removed, the production casing 14 is severed at a position above the casing hanger 18 and additional sealing means and control valves are installed on the casing head 19 prior to production.

Many modifications may be made in the invention and the specific embodiments disclosed. For example, the position of the seal is not highly specific. It need only be in a position where it can be compressed automatically when the casing hanger is lowered into operating position. Other modifications are also possible. The invention therefore, should only be construed by reference to the accompanying claims.

I claim:

1. A casing hanger for use in supporting production well casing within a casing head having an internal surface adjacent the upper end thereof, said casing hanger comprising slip bowl means operable to be seated on a shoulder within said casing head, slip means cooperating with said slip bowl means and having threads thereon adapted to grip said well casing, flexible seal means supported across its bottom area by said slip bowl means, cap wedge plate means, spreader means below said cap wedge plate means having an external surface for cooperating with said casing head internal surface, lower wedge plate means between said flexible seal means and said spreader means and attachment means threadedly engaging said slip bowl means and retaining said slip bowl means, said flexible seal, said lower wedge plate means, said spreader means and said cap wedge plate means, whereby the spreader means external surface contacts the internal surface of the casing head which tends to separate the cap wedge plate from the lower wedge plate to compress the flexible seal means and to create a seal between the casing and the casing head.

2. A casing hanger as in claim 1 wherein said flexible seal means creates said sealing action when said lower wedge plate means and said cap wedge plate means are moved axially apart by said spreader means.

3. A casing hanger as in claim 2 wherein said attachment means is a bolt adapted to adjustably increase or decrease the compression force on said flexible seal means.

4. A casing hanger as in claim 3 wherein said spreader means causes said flexible seal to be created by wedge action between said lower wedge plate means and said cap wedge plate means.

5. A casing hanger as in claim 4 wherein said attachment means is adjustable while said casing hanger is in operable position without movement of said production casing.

6. A casing hanger as in claim 5 and further comprising a shoulder on said slip bowl means adapted to cooperate with said shoulder in said casing head, said shoulder on said slip bowl means adapted to abut said shoulder on said casing head when said casing hanger is in operable position.

7. A casing hanger as in claim 6 wherein said slip bowl means cooperates with said slip means through an interface, said interface being adapted to exert a compressive force on said production casing through said threads of said slip means of a magnitude less than the strength of said production casing.

8. A casing hanger for use in supporting production well casing in a casing head and isolating well pressure from the atmosphere, the casing head having an internal surface adjacent the upper end thereof, said casing hanger comprising slip bowl means including a shoulder adapted to abut a complementary shoulder on said casing head when in operating position, slip means complementary to said slip bowl means and having threads thereon adapted to grip and support said well casing, flexible seal means adapted to be compressed and form a seal between said casing head and said production casing, lower wedge plate means on said flexible seal means adapted to compress said flexible seal means, spreader means on said lower wedge plate means having an external surface for cooperating with said casing head internal surface, a cap wedge plate means on said spreader means and attachment means threadedly engaging said slip bowl means and retaining said slip bowl means, said flexible seal means, said lower wedge plate means, said spreader means and said cap wedge plate means whereby upon insertion of said casing hanger about said well casing and into said casing head, said spreader means external surface contacts the internal surface of the casing head which tends to separate the cap wedge plate from the lower wedge plate to compress the flexible seal means and to to create a seal between the casing and the casing head.

9. A casing hanger as in claim 8 wherein said spreader means acts to compress said seal means through wedging action between said spreader means and said cap wedge plate means and lower wedge plate means.

10. A casing hanger as in claim 9 wherein said attachment means is a bolt adapted to increase or decrease compressive force on said flexible seal means.

* * * * *